United States Patent [19]

Szewczyk et al.

[11] Patent Number: 4,926,803

[45] Date of Patent: May 22, 1990

[54] RADIAL-PISTON ENGINE

[75] Inventors: Mattias Szewczyk; Hans-Jürgen Pöting, both of Witten, Fed. Rep. of Germany

[73] Assignee: Paul Pleiger Maschinenfabrik GmbH & Co. KG, Fed. Rep. of Germany

[21] Appl. No.: 277,287

[22] Filed: Nov. 29, 1988

[51] Int. Cl.[5] ..... F01B 1/06

[52] U.S. Cl. ..... 123/55 R; 123/55 A

[58] Field of Search ..... 123/55 R, 55 A

[56] References Cited

U.S. PATENT DOCUMENTS 1,835,138 12/1931 Bowman ..... 123/55 A
4,727,794 3/1988 Kmicikiewicz ..... 123/55 A

FOREIGN PATENT DOCUMENTS 2244920 4/1974 Fed. Rep. of Germany .
2333103 1/1975 Fed. Rep. of Germany .
3430362 2/1986 Fed. Rep. of Germany .
3441966 5/1986 Fed. Rep. of Germany .
2185075 7/1987 United Kingdom .

*Primary Examiner*—David A. Okonsky
*Attorney, Agent, or Firm*—Wood, Dalton, Phillips Mason & Rowe

[57] ABSTRACT

In order to obtain a self-control of the working pistons with a simple, space-saving construction in the case of a radial-piston engine having pot-shaped pistons which are in contact with the circumference of an eccentric shaft and into which there engages in each case a guide body mounted radially outside on the housing in floating arrangement, and having fluid ports in the cylinder cover for the inflow and outflow of the pressure fluid, a control element (15), connected in jointed manner to the guide body (5), is adjustably disposed in the cylinder cover (9) or a corresponding component of the housing, for controlling the inflow and outflow ports (19, 20).

8 Claims, 4 Drawing Sheets

RADIAL-PISTON ENGINE

The invention relates to a radial-piston engine according to the preamble of claim 1.

Various configurations of radial-piston engines of this type are known (for example German Offenlegungsschrift 3,430,362), the control of the fluid impingement of the individual pistons being accomplished in each case by a complex apparatus which has a considerable space requirement and increases weight and costs of a radial-piston engine, the control having a drive independent of the working piston movement, as a result of which disruptions in the interaction of working piston movement and control movement may occur.

A design is known from German Patent Specification 2,244,920 in which the control of the fluid impingement takes place directly by the movement of the working pistons. In this case, a certain space requirement is required in each individual cylinder.

The invention is based on the object of designing a radial-piston engine of the type specified at the beginning in such a way that a self-control of the working pistons is obtained with a simple and space-saving construction.

This object is achieved by the features in the defining part of claim 1. The arrangement of a control element in the cylinder cover, which is adjusted by the pendulum motion of the guide body of the assigned working piston, produces an indirect self-control of the working pistons with small overall volume of the control, combined with low weight and inexpensive production costs.

Advantageous developments of the invention are specified in the further claims and in the following description.

An exemplary embodiment of the invention is explained in more detail below with reference to the drawing, in which.

Figure 1:
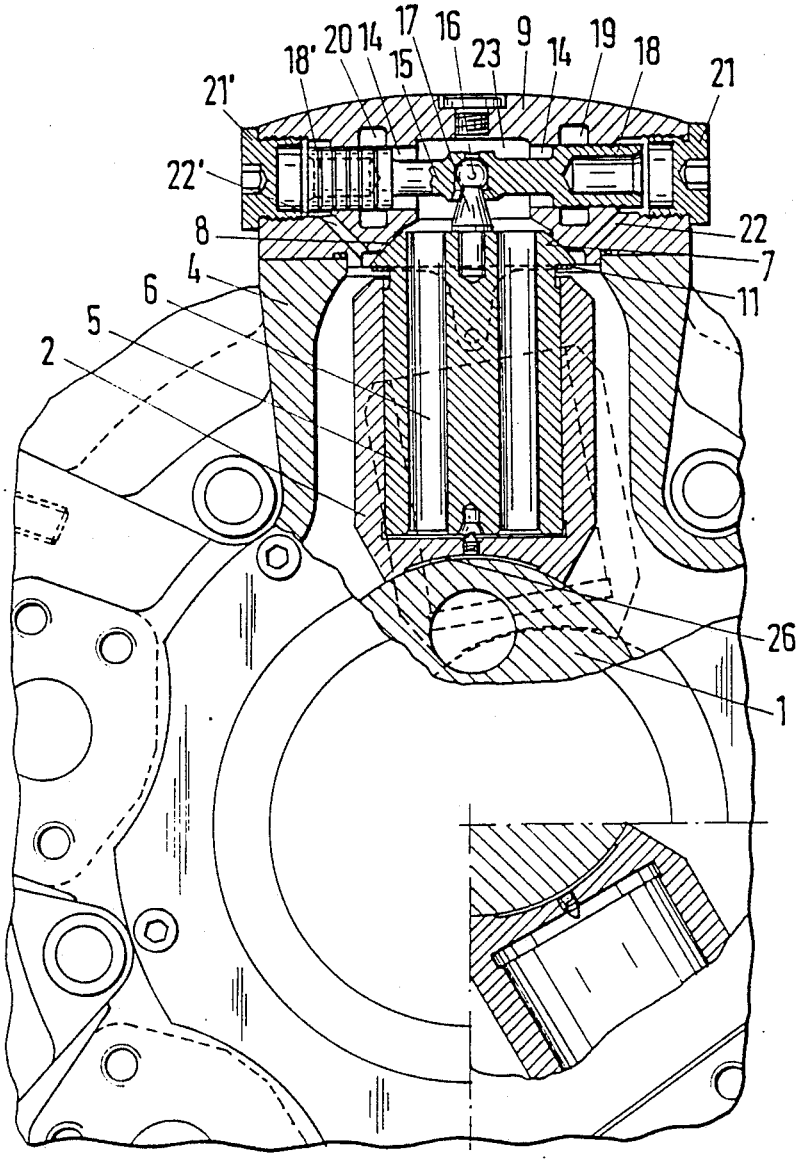
FIG. 1 shows a longitudinal section through a cylinder with piston arrangement.
Figure 2:
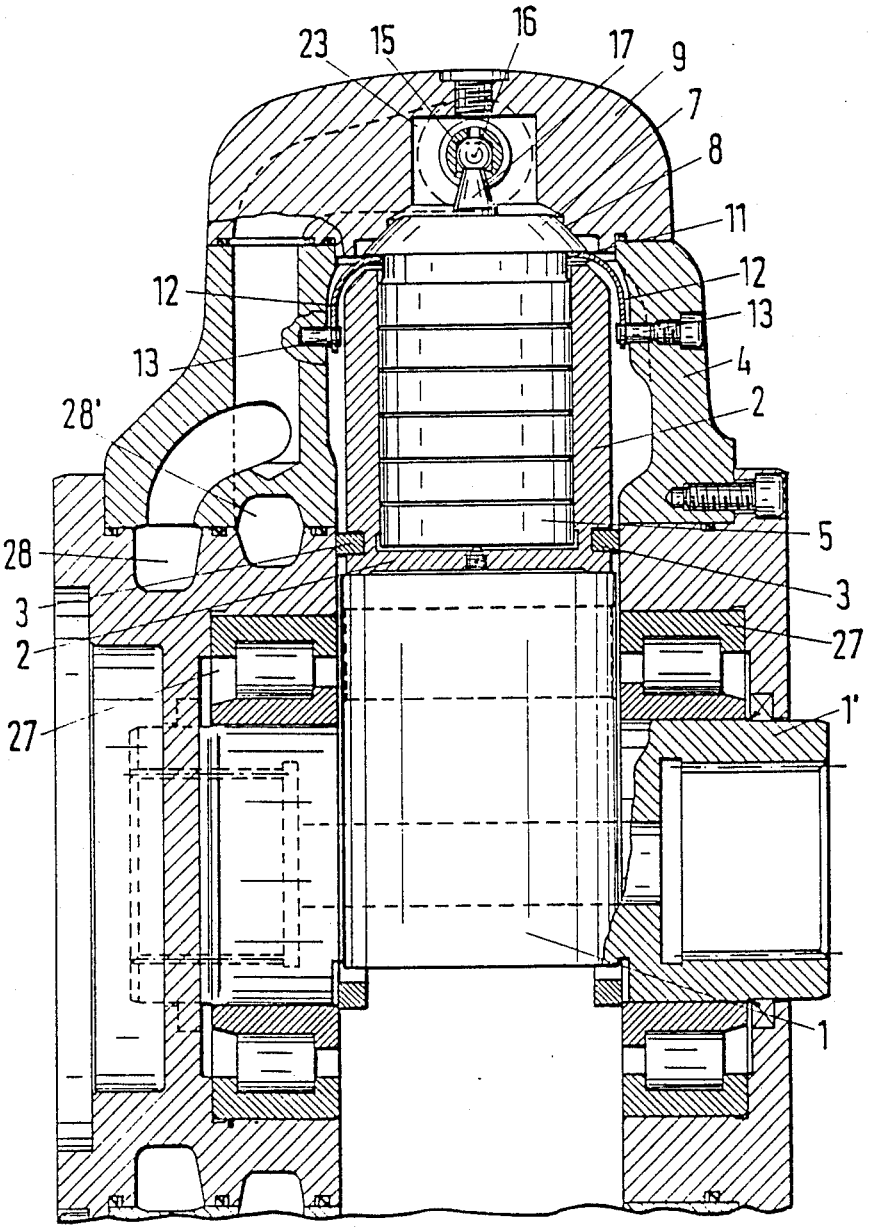
FIG. 2 shows a longitudinal section through a cylinder extending perpendicularly to the longitudinal section according to FIG. 1.

In FIGS. 1 and 2, 1 denotes an eccentric arranged on the output shaft 1' of the radial-piston engine, on the outer circumference of which eccentric pot-shaped designed working pistons 2 are in contact with the closed side. The working pistons 2 are guided by restraining rings 3 on the eccentric circumference and they are in each case arranged in a radially extending, cylinder-shaped extension piece 4 of the housing of the radial-piston engine, these cylinder-shaped extension pieces 4 being arranged in a star shape around the eccentric 1. Into the piston 2 there engages a guide body 5, which is provided in its axial direction with breakthroughs 6 for the passage of the pressurized fluid, with which the piston 2 is impinged. At the radially outer end, the guide body 5 is provided with an annular bearing surface in the form of a radially outwardly convex spherical segment surface, against which a bearing surface 8 of complementary shape of a cylinder cover 9 is in contact, which is fixed by means of screws 10 (FIG. 3) on the cylinder-shaped extension piece 4 of the housing. A spring element 11 shaped in the form of a ring and having diametrically opposite extension pieces 12, which are fixed to the housing via pins 13, is in contact with an annular shoulder of the guide body 5. The guide body 5 is held by this spring element with its bearing surface 7 in contact with the bearing surface 8 of the cylinder cover.

Figure 3:
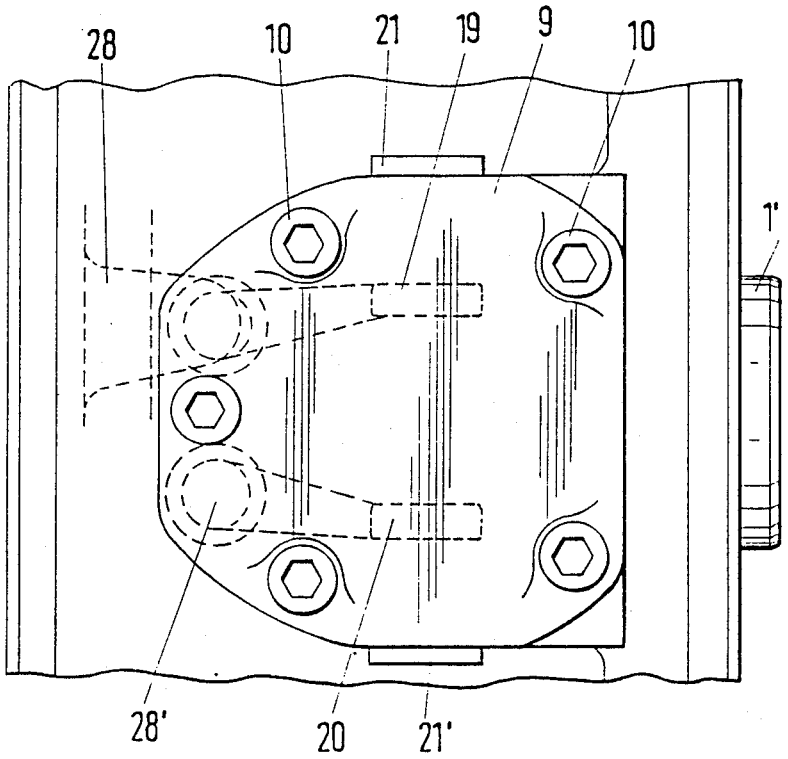
FIG. 3 shows a plan view of the cylinder cover.

In each cylinder cover 9 there is in each case a rod-shaped control element 15, which is connected via a spherical joint 16 to the guide body 5, displaceably guided in a through-bore 14 extending transversely to the eccentric axis. In the case of the exemplary embodiment shown, there is fixed on the guide body 5 a radially outwardly projecting pin 17, which engages with a spherical joint body on its free end in a correspondingly shaped recess in the middle of the rod-shaped control element 15. On both sides of the ball joint 16, piston-shaped extension pieces 18, 18' are formed on the free ends of the rod-shaped control element 15. In the displacement region of these piston-shaped extension pieces 18, 18', in the cylinder cover 9 there is formed in each case an annular groove 19 and 20, respectively, of which one is connected to a fluid inflow port and the other is connected to a return port, as FIG. 3 shows by broken lines. These ports are formed in the cylinder cover 9 and are in connection with assigned bores in the housing of the radial-piston engine. The transverse through-bore 14 in the cylinder cover 9 is closed at both ends by a closure plug 21, 21'. The intermediate space between end faces of the control element 15 and closure plugs 21, 21', is connected via a bore 22, 22' with the inner space of the housing.

In operation of the radial-piston engine, the working piston 2 is swung by the rotation of the eccentric 1, for example into the position reproduced by broken lines in FIG. 1, the guide body 5 entering the piston 2 being swung correspondingly. This involves the control element 15 being displaced to the left by means of the spherical joint 16 out of the central position shown in FIG. 1, so that the annular groove 20 is cleared and the annular groove 19 remains closed off. The pressure fluid can impinge the piston 2, for example via the bore 14, its widened middle section 23 and the breakthroughs 6 in the guide body 5. In the following pendulum motion of the piston 2 in the opposite direction, the corresponding pendulum motion of the guide body 5 blocks off the annular groove 20 and clears the annular groove 19, so that the fluid can flow off radially outwards into the return due to the piston motion. In this way, an indirect self-control of the fluid impingement is achieved by the motion of the working piston 2.

Figure 4:
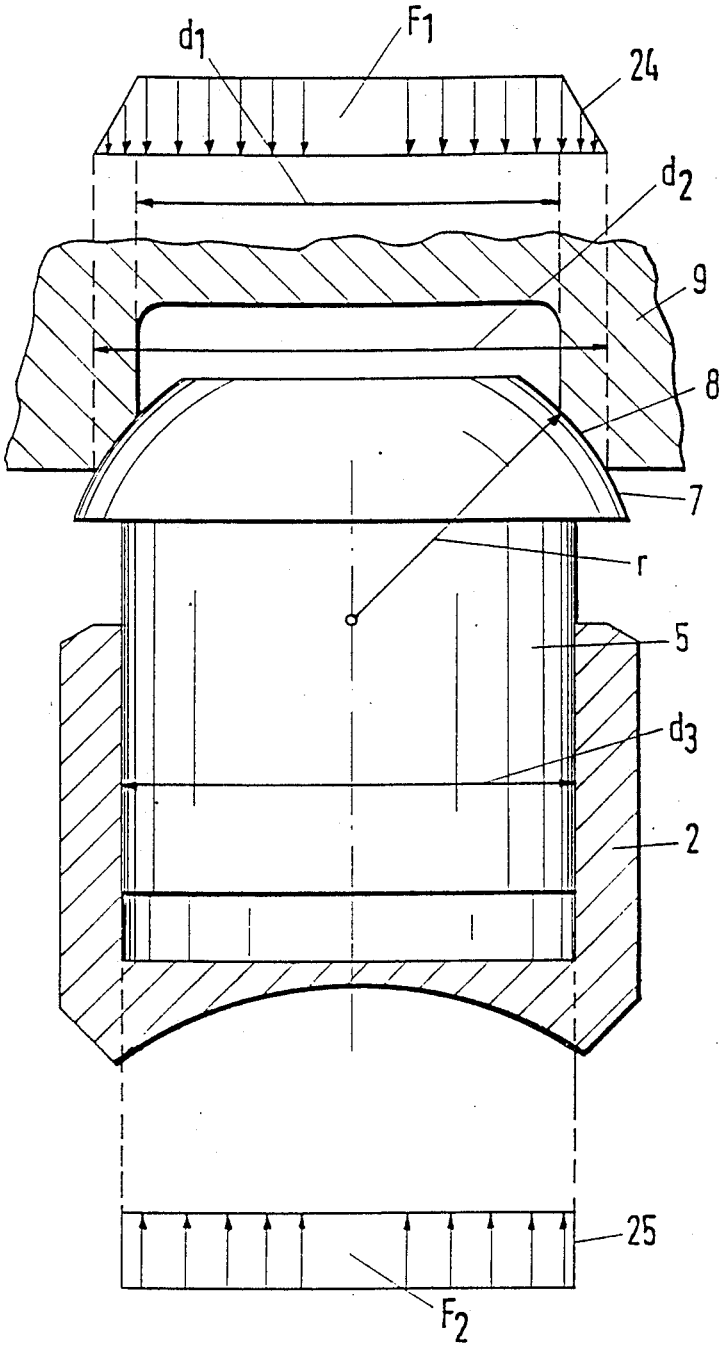
FIG. 4 shows the force distribution on a diagrammatically represented guide body with piston.

FIG. 4 explains the pressure relief of the guide body 5 in the case of the design according to FIGS. 1 and 2. Application of the fluid pressure to the radially outer end face of the guide body 5 produces the force distribution reproduced by arrows at 24, the reduction on both sides of the force applied being due to the width of the bearing surface 8, on which the compressive force corresponds on the inside to the maximum applying pressure and on the outside to the value 0, which is the value inside the housing. With a view to the pendulum motion of the guide body 5, its bearing surface 7 is made wider than the bearing surface 8 in the cylinder cover 9. At the radially inner end face of the guide body 5 the force distribution reproduced at 25 is produced by the pressure fluid impinging the piston 2. $d_1$ denotes the inside diameter of the bearing surface 8 in the cylinder cover and $d_2$ denotes its outside diameter. $d_3$ indicates the diameter of the section of the guide body 5 engaging in the piston 2.

If the outside diameter $d_3$ of the guide body 5 is designed in relation to the outside and inside diameters of the bearing surface 8 such that $$d_3 = \frac{d_1 + d_2}{2},$$

a force distribution $F_1 = F_2$ is produced. This means a one hundred-percent relief of the guide body 5 upon pressurization of the working piston 2.

$d_1$ and $d_2$ may be chosen as desired, so that the force distribution $F_1$ may be made greater than $F_2$ or $F_2$ may be made greater than $F_1$, depending on what is regarded as expedient in an individual case.

On the bearing surface of the piston against the eccentric there is formed, in a way known per se, a relief chamber 26, which is in connection with the inner space of the piston.

The output shaft 1' is mounted by means of bearings 27 in the housing of the radial-piston engine.

In FIG. 2, 28, 28' denote annular ports in the housing of the radial-piston engine, which are connected to the ports 19, 20 in the cylinder cover and the main connections for inflowing and outflowing fluid. FIGS. 2 and 3 show an arrangement of the ports for inflowing and outflowing fluid in which the two ports are accommodated alongside each other in one of the cylinder-shaped extension pieces 4 of the housing. If ports of relatively large cross-section are provided, they may then be arranged individually, each on one of the cylindrical extension pieces 4.

Various modifications of the described design are possible. For instance, a control slide valve may also be provided in the cylinder cover 9, which executes a swinging motion due to the pendulum motion of the guide body 5 and clears and blocks off ports extending perpendicular to the direction of the swinging motion.

We claim:

1. A radial-piston engine having radially extending cylinders and a housing with respective cylinder covers and having pot-shaped pistons which are in contact with the circumference of an eccentric shaft and into which there engages in each piston a guide body mounted radially beyond the piston to the respective cylinder cover in floating arrangement, and having fluid ports in the cylinder cover for the inflow and outflow of a pressure fluid, wherein a control element (15), connected in jointed manner to the guide body (5), is adjustably disposed in the housing for controlling the inflow and outflow ports (19, 20).

2. The radial-piston engine as claimed in claim 1, wherein the guide body (5) is mounted in floating arrangement by means of a spherical segment surface (7) and is connected to the control element (15) by a spherical joint (16).

3. The radial-piston engine as claimed in claim 1 wherein the control element (15) is designed in the form of a rod and can be displaced in a bore (14), extending transversely to the eccentric axis, in the cylinder cover (9) along its axis.

4. The radial-piston engine as claimed in claim 3, wherein the transversely extending bore (14) is made right through the cylinder cover (9) and is closed at the ends by closure plugs (21, 21'), the end spaces on both sides of the control element (15) being connected via bores (22, 22') to the inner space of the housing.

5. The radial-piston engine as claimed in claim 3, wherein the rod-shaped control element (15) is provided at the opposite ends with piston-shaped extension pieces (18, 18'), which can be displaced in the region of annular grooves (19, 20) in the cylinder cover (9).

6. The radial-piston engine as claimed in claim 1, wherein the guide body (5) is provided with a radially outwardly convex bearing surface (7) and an opposite bearing surface (8) on the cylinder cover (9) is of concave design.

7. The radial-piston engine as claimed in claim 6, wherein the guide body (5) is held in contact with the bearing surface (8) by a spring element (11).

8. A radial-piston engine as claimed in claim 6, wherein the outside diameter of the guide body (5) is equivalent to the average diameter of the bearing surface (8) in the cylinder cover (9), to achieve a complete pressure relief.

* * * * *

UNITED STATES PATENT AND TRADEMARK OFFICE

CERTIFICATE OF CORRECTION

PATENT NO. : 4,926,803

DATED : May 22, 1990

INVENTOR(S) : Dr.-Ing. Mattias Szewczyk

It is certified that error appears in the above-identified patent and that said Letters Patent is hereby corrected as shown below:

On the title page, add the following:

--[30] Foreign Application Priority Data December 2, 1987
[DE] Fed. Republic of Germany--.

Signed and Sealed this

Twenty-first Day of January, 1992

*Attest:*

*Attesting Officer*

HARRY F. MANBECK, JR.

*Commissioner of Patents and Trademarks*